US007513612B2

(12) United States Patent
Takagi

(10) Patent No.: US 7,513,612 B2
(45) Date of Patent: Apr. 7, 2009

(54) PROTECTOR FOR INK CARTRIDGE

(75) Inventor: Atsuhiro Takagi, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 366 days.

(21) Appl. No.: 11/274,252

(22) Filed: Nov. 16, 2005

(65) Prior Publication Data

US 2006/0103702 A1 May 18, 2006

(30) Foreign Application Priority Data

Nov. 18, 2004 (JP) ..... 2004-333922

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS

| | | | | |
|---|---|---|---|---|
| 5,138,344 | A | 8/1992 | Ujita | |
| 5,648,802 | A | 7/1997 | Abe | |
| 5,777,646 | A * | 7/1998 | Barinaga et al. | 347/86 |
| RE36,279 | E | 8/1999 | Ujita | |
| 6,097,407 | A * | 8/2000 | Terasawa et al. | 347/31 |
| 6,409,325 | B1 * | 6/2002 | Matsumoto et al. | 347/87 |
| 6,416,173 | B2 | 7/2002 | Kishida et al. | |
| 6,609,788 | B2 | 8/2003 | Hatasa et al. | |
| 6,786,581 | B1 | 9/2004 | Shinada et al. | |
| 6,916,085 | B2 * | 7/2005 | Kotaki et al. | 347/49 |

(Continued)

FOREIGN PATENT DOCUMENTS

| | | |
|---|---|---|
| EP | 0778144 | 6/1997 |

(Continued)

OTHER PUBLICATIONS

European Search Report dated Feb. 24, 2006.

*Primary Examiner*—Anh T. N. Vo
(74) *Attorney, Agent, or Firm*—Baker Botts L.L.P.

(57) ABSTRACT

A protector for use with an ink cartridge. The ink cartridge includes an ink chamber which stores an ink; an ink supply hole through which the ink is supplied from the ink chamber to an outside of the ink cartridge and which opens in a hole-open portion of an outer surface of the ink cartridge; and a valve member which is provided between the ink chamber and the ink supply hole, which selectively permits the ink to flow from the ink chamber to the ink supply hole and inhibits the ink from flowing from the ink chamber to the ink supply hole, and which communicates with the outside via the ink supply hole. The protector includes a main portion including an engaging portion which is adapted to engage a portion of the ink cartridge so that the protector is detachably attached to the ink cartridge. The main portion has a rigidity assuring that the main portion can substantially maintain an original shape thereof. The main portion further includes an access-restraining portion which is adapted to be located, in a state in which the protector is attached to the ink cartridge, outside the ink supply hole so as to at least partly cover the hole-open portion of the outer surface of the ink cartridge and thereby restrain an external access to the valve member via the ink supply hole.

20 Claims, 6 Drawing Sheets

U.S. PATENT DOCUMENTS 7,287,843 B2 * 10/2007 Muranaka et al. ..... 347/86

FOREIGN PATENT DOCUMENTS

| | | |
|---|---|---|
| JP | 2001 113723 | 4/2001 |
| JP | 3222454 | 8/2001 |
| JP | 2001 277531 | 10/2001 |
| JP | 3295366 | 4/2002 |
| JP | 2004 50698 | 2/2004 |
| WO | WO 0228645 | 4/2002 |

* cited by examiner

PROTECTOR FOR INK CARTRIDGE

The present application is based on Japanese Patent Application No. 2004-333922 filed on Nov. 18, 2004, the contents of which are incorporated herein by reference.

BACKGROUND OF THE INVENTION

1. Field of the Invention

The present invention relates to a protector that can prevent leakage of ink from an ink cartridge before the cartridge is attached to a recording device.

2. Discussion of Related Art

Japanese Patent Application Publication No. 2001-113723 or its corresponding U.S. Pat. No. 6,786,581B1 discloses an ink cartridge having an ink supply hole in which a valve member is provided. In a state of the ink cartridge before it is attached to an inkjet recording device, a compression spring elastically presses the valve member against a tubular packing member provided in the ink supply hole, so as to prevent leakage of ink from the ink supply hole. Meanwhile, when the ink cartridge is attached to the inkjet recording device, a tubular ink-supply needle pushes the valve member against the biasing force of the compression spring, so as to open the ink supply hole and thereby allow the ink to be supplied from the ink cartridge to the recording device.

However, the above-described valve member communicates with an outside space via the ink supply hole. Therefore, if the valve member is erroneously assembled in a tilted state when the ink cartridge is manufactured, or if the valve member is tilted by being interfered with by a foreign matter or a working person when the ink cartridge is manufactured or shipped, the ink may leak through the valve member tilted.

SUMMARY OF THE INVENTION

It is therefore an object of the present invention to solve at least one of the above-indicated problems. It is another object of the present invention to provide a protector that can protect a valve member of an ink cartridge and thereby prevent leakage of ink from the cartridge.

The above objects may be achieved according to the present invention. According to the present invention, there is provided a protector for use with an ink cartridge. The ink cartridge includes an ink chamber which stores an ink; an ink supply hole through which the ink is supplied from the ink chamber to an outside of the ink cartridge and which opens in a hole-open portion of an outer surface of the ink cartridge; and a valve member which is provided between the ink chamber and the ink supply hole, which selectively permits the ink to flow from the ink chamber to the ink supply hole and inhibits the ink from flowing from the ink chamber to the ink supply hole, and which communicates with the outside via the ink supply hole. The protector comprises a main portion including an engaging portion which is adapted to engage a portion of the ink cartridge so that the protector is detachably attached to the ink cartridge. The main portion has a rigidity assuring that the main portion can substantially maintain an original shape thereof. The main portion further includes an access-restraining portion which is adapted to be located, in a state in which the protector is attached to the ink cartridge, outside the ink supply hole so as to at least partly cover the hole-open portion of the outer surface of the ink cartridge and thereby restrain an external access to the valve member via the ink supply hole.

In the ink-cartridge protector in accordance with the present invention, the main portion thereof has a rigidity assuring that the main portion can substantially maintain its original shape, the engaging portion thereof is adapted to engage a portion of the ink cartridge, so that the protector is detachably attached to the ink cartridge, and the access-restraining portion thereof is adapted to be located outside the ink supply hole so as to at least partly cover the hole-open portion of the outer surface of the ink cartridge and thereby restrain external accesses to the valve member via the ink supply hole. Since an outside surface of the access-restraining portion is remoter from the valve member than the hole-open portion of the outer surface of the ink cartridge, the access-restraining portion can more effectively prevent the foreign accesses to the valve member than the hole-open portion. Therefore, when the ink cartridge is manufactured or is shipped, the protector can restrain a foreign matter or a person from interfering with the valve member. Thus, the valve member can be protected, and the leakage of the ink, caused by, e.g., tilting of the valve member resulting from the interference, can be prevented.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENT

Figure 1:
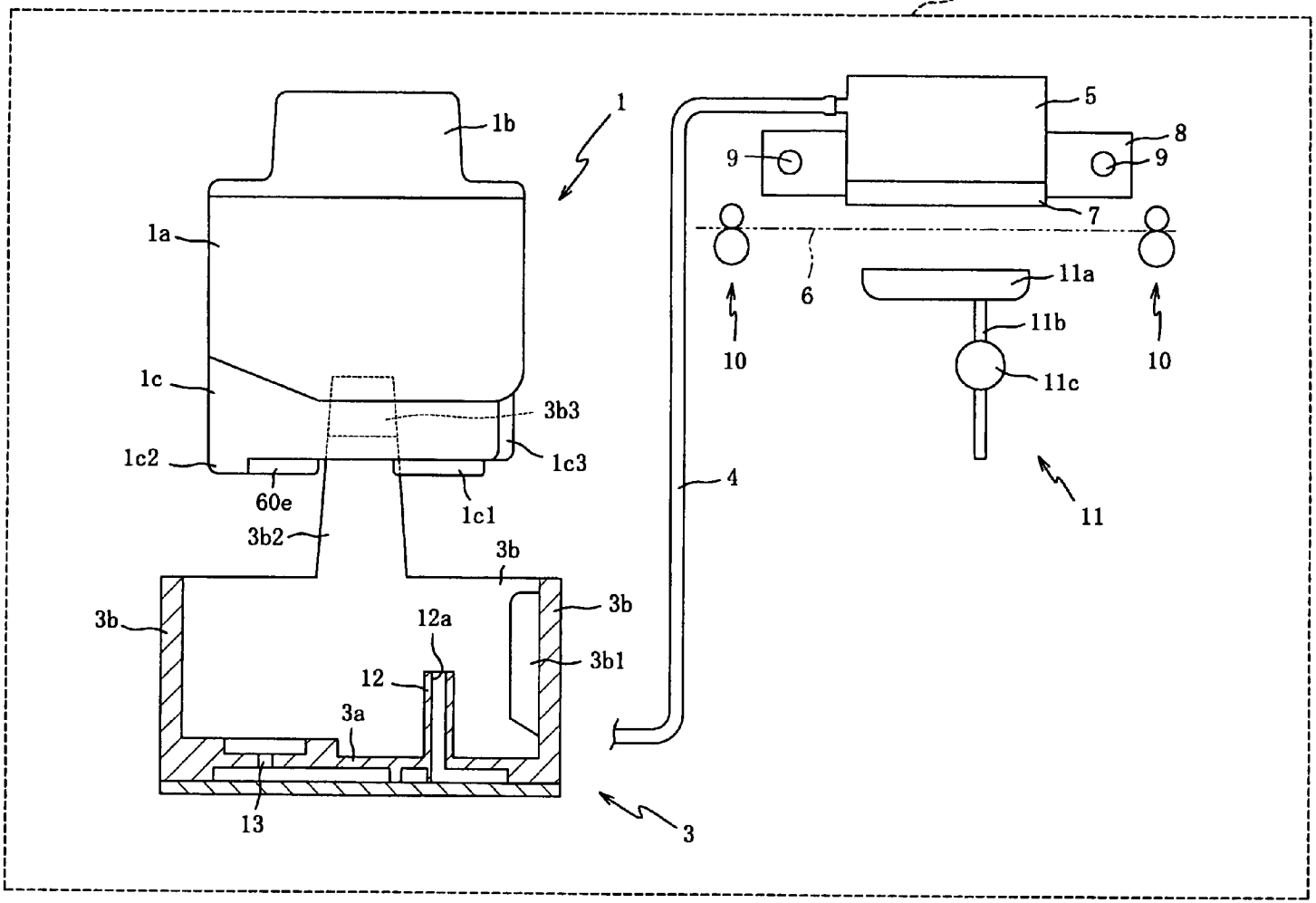
FIG. 1 is an illustrative view of an ink cartridge that is protected by a protector as an embodiment of the present invention, and an inkjet recording device to which the ink cartridge is detachably attached.

Hereinafter, there will be described preferred embodiments of the present invention by reference to the drawings. First, there will be described a general construction of an inkjet recording device 2, by reference to FIGS. 1, 2, and 3. The inkjet recording device 2 is used with a plurality of ink cartridges 1. Each of the ink cartridges 1 is protected by a protector 70 (FIG. 4) to which the present invention is applied, before it is used with the inkjet recording device 2.

The inkjet recording device 2 includes a plurality of cartridge holders 3 each of which holds a corresponding one of the plurality of ink cartridges 1, such that the corresponding ink cartridge 1 is attachable to, and detachable from, the each cartridge holder 3. The inkjet recording device 2 is used with, e.g., four ink cartridges 1 that store four different color inks, respectively, for example, a cyan ink, a magenta ink, a yellow ink, and a black ink. In this case, the inkjet recording device 2 includes four cartridge holders 3 that hold the four ink cartridges 1, respectively. Since the ink cartridges 1 have an identical construction and the cartridge holders 3 have an identical construction, the following description relates to only a representative one of the ink cartridges 1 and a representative one of the cartridge holders 3.

The inkjet recording device 2 additionally includes an ink tank 5 that reserves an ink supplied from the ink cartridge 1 via an ink supply tube 4; a recording head 7 that ejects droplets of the ink reserved by the ink tank 5, toward a recording sheet 6 as a sort of recording medium; a carriage 8 that carries the ink tank 5 and the recording head 7 and is linearly reciprocated; two guide shafts 9 that cooperate with each other to guide the reciprocal movements of the carriage 8; a sheet feeder 10 that feeds the recording sheet 6; and a purging device 11.

The cartridge holder 3 includes a base portion 3*a*, and two guide portions 3*b* that project upward from two opposite sides of the base portion 3*a*, respectively. The base portion 3*a* has an ink delivery tube 12 that projects upward into an inner space of the cartridge holder 3 and supplies the ink stored by the ink cartridge 1, to the ink supply tube 4; and an air supply hole 13 that supplies an ambient air into the ink cartridge 1.

The ink supply tube 4 is connected, at one end thereof, to a lower end of the ink delivery tube 12, and is communicated, at another end thereof, with the ink tank 5. The air supply hole 13 is communicated with the ambient air, i.e., the atmosphere via a labyrinth-like air-flow passage, not shown.

As shown in FIG. 1, one of the two guide walls 3*b* that projects upward from one of lengthwise opposite ends of the base portion 3*a*, more specifically described, that is located on the side of the ink delivery tube 12, has, on an inner surface thereof, two first ribs 3*b*1 (FIG. 3) that extend, parallel to each other, in a direction in which the ink cartridge 1 is attached to, and detached from, the cartridge holder 3, and are spaced from each other in a direction perpendicular to a lengthwise direction of the base portion 3*a*. In addition, the base portion 3*a* has, on the side of the air supply hole 13 that is lengthwise opposite to the ink delivery tube 12, two recessed portions 3*a*1 (FIG. 3) that are spaced from each other in the direction perpendicular to the lengthwise direction of the base portion 3*a*.

The ink cartridge 1 has, on a side surface thereof that is opposed to the two first ribs 3*b*1 when the cartridge 1 is attached to the cartridge holder 3, a second rib 1*c*3 that is to be inserted in a space present between the two first ribs 3*b*1. In addition, the ink cartridge 1 has, on a lower surface thereof opposite to the above-indicated side surface thereof, two second projecting portions 1*c*2 (a first projecting portion 1*c*1 will be described later) that are to be inserted in the two recessed portions 3*a*1, respectively. Since the second rib 1*c*3 is inserted in the space between the two first ribs 3*b*1 and the two second projecting portions 1*c*2 are inserted in the two recessed portions 3*a*1, respectively, the ink cartridge 1 is accurately positioned in the cartridge holder 3. The two second projecting portions 1*c*2 provide at least one protruding portion of the ink cartridge 1.

Figure 3:
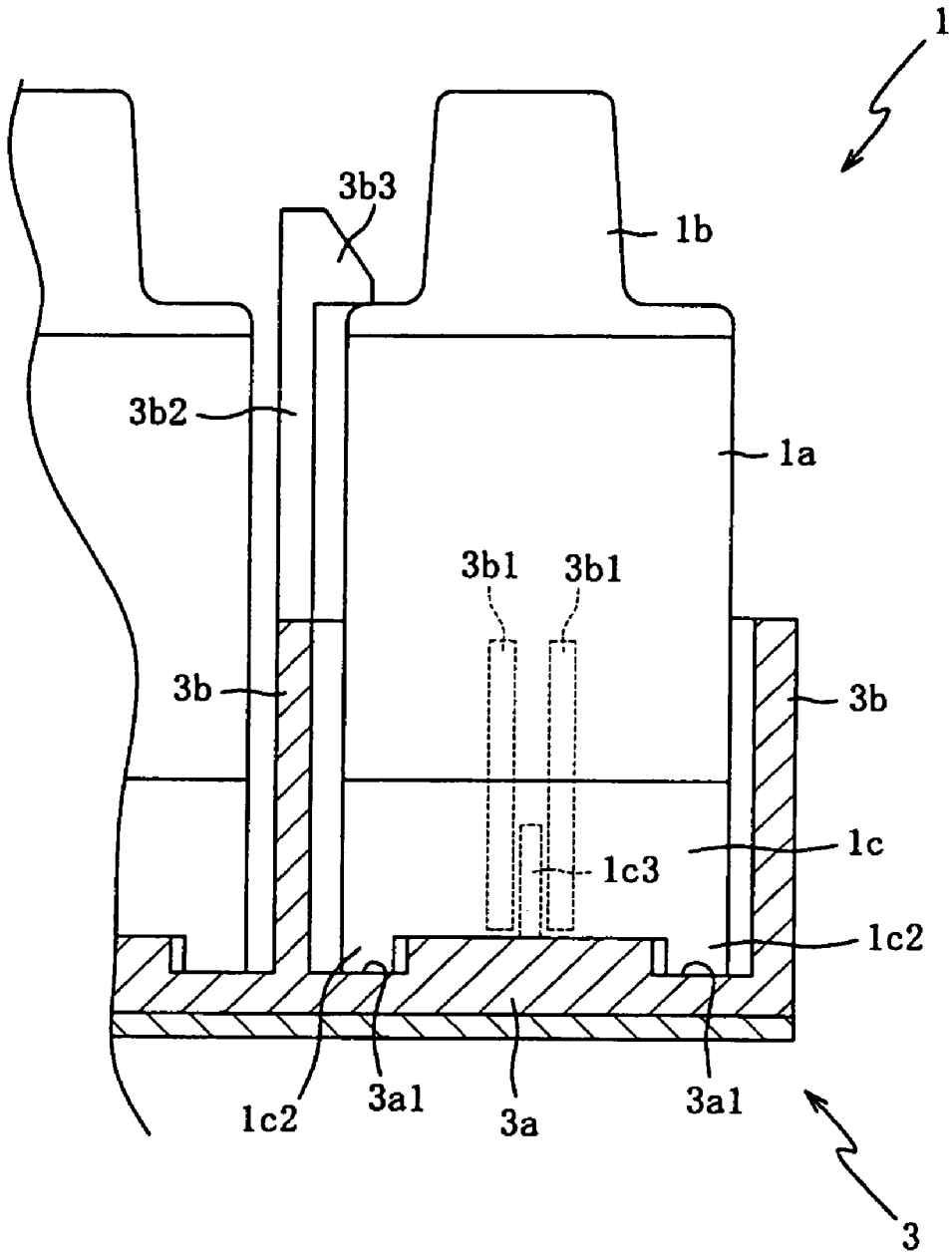
FIG. 3 is a cross-section view taken along 3-3 in FIG. 2.

As shown in FIG. 3, the cartridge holder 3 additionally includes a third guide wall 3*b* which extends in the lengthwise direction of the base portion 3*a* and from which an elastically deformable arm 3*b*2 projects upward. The arm 3*b*2 has, as an upper end portion thereof, an engaging portion 3*b*3. When the ink cartridge 1 is attached to the cartridge holder 3, the arm 3*b*2 is elastically deformed to allow the engaging portion 3*b*3 to engage an upper surface of the ink cartridge 1. Thus, the ink cartridge 1 remains attached to the cartridge holder 3.

The recording head 7 has a plurality of ink ejection nozzles, not shown, and a piezoelectric actuator, not shown, that is deformable to eject, from an arbitrary one of the nozzles, a droplet of the ink supplied from the ink tank 5, toward the recording sheet 6.

The purging device 11 is provided, at a location beyond a recording area in which the recording head 7 can record images on the recording sheet 6, such that the purging device 11 can be opposed to the recording head 7 being positioned at that location. The purging device 11 includes a purging cap 11*a* that covers a nozzle-defining surface of the recording head 7 that defines the nozzles; a purging tube 11*b* that communicates with the purging cap 11*a*; and a suction pump 11*c* that sucks the ink from the nozzles via the purging tube 11*b*.

Figure 4:
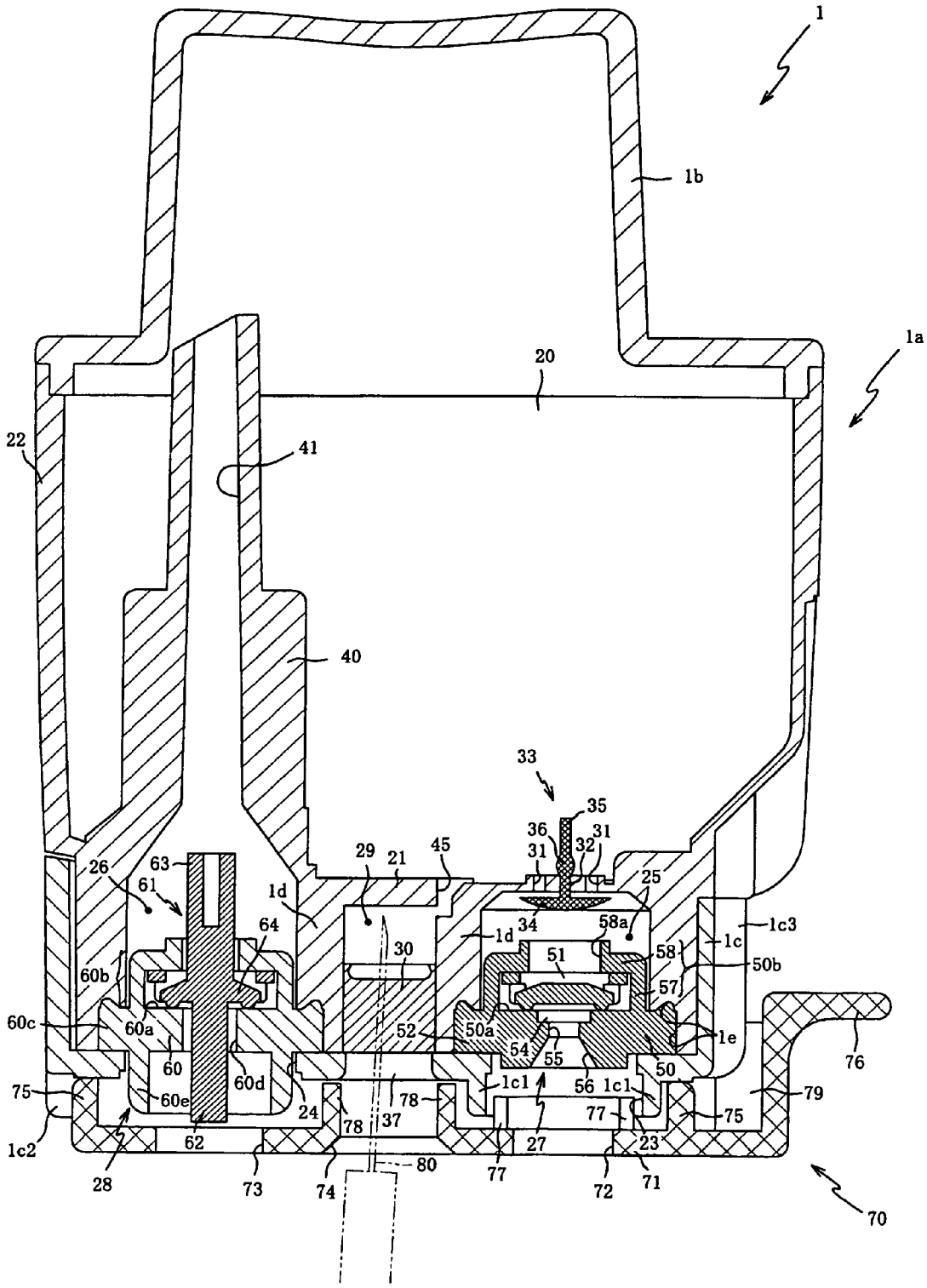
FIG. 4 is a cross-section view of the ink cartridge in a state in which the cartridge is protected by the protector.

As shown in FIG. 4, the ink cartridge 1 includes a main case 1*a* that holds an ink and opens upward; a lid member 1*b* that covers an upper open end of the main case 1*a*; and a cap member 1*c* that covers a lower end of the main case 1*a*. The main case 1*a*, the lid member 1*b*, and the cap member 1*c* are each formed of a resin, and are integrally fixed to each other by supersonic welding, thermal welding, or adhesion.

The main case 1*a* has an ink chamber 20 that stores the ink; a bottom wall 21 that defines a bottom of the ink chamber 20; and a side wall 22 that extends from an outer periphery of the bottom wall 21, in an upward direction (FIG. 4), and cooperates with the bottom wall 21 to define the ink chamber 20.

The bottom wall 21 has a supply chamber 25 that supplies the ink from the ink chamber 20 to the outside of the ink cartridge 1; an air introducing chamber 26 that introduces the ambient air into the ink chamber 20; and an ink charging chamber 29 through which the ink is charged into the ink chamber 20. Each of the supply chamber 25, the air introducing chamber 26, and the ink charging chamber 29 is defined by a corresponding one of three tubular walls 1*d* that are integrally formed with the bottom wall 21 and project downward from a lower surface of the same 21.

The cap member 1*c* has an ink supply hole 23, an air introducing hole 24, and an ink charging hole 37 at respective positions where the ink supply hole 23, the air introducing hole 24, and the ink charging hole 37 are opposed to the supply chamber 25, the air introducing chamber 26, and the ink charging chamber 29, respectively, and thereby allow the corresponding chambers 25, 26, 29 to communicate with the space outside the ink cartridge 1. The cap member 1*c* has the above-described second lib 1*c*3 on a side surface thereof that is located on the side of one of lengthwise opposite ends thereof, and additionally has the above-described two second projecting portions 1*c*2 on a lower surface thereof that is located on the side of the other lengthwise end thereof. More specifically described, the two second projecting portions 1*c*2 are provided on either side of the air introducing hole 24. The cap member 1*c* further has a tubular, first projecting portion 1*c*1 that projects downward from the lower surface thereof and defines, therein, the ink supply hole 23. The first projecting portion 1*c*1 provides at least one protruding portion of the ink cartridge 1. Each of the first projecting portion 1*c*1 and the two second projecting portions 1*c*2 projects, from the lower surface of the cap member 1*c*, in a direction parallel to a direction in which an operable portion 62 of a second valve device 28 (a first valve device 27 will be described later) projects beyond the lower surface of the cap member 1*c*, by an amount substantially equal to, or greater than, an amount of projection of the operable member 62. Thus, the ink cartridge 1 can be stably placed on, e.g., a desk in such a manner that the cartridge 1 takes an upright posture in which the cartridge 1 rests on the three projecting portions 1*c*1, 1*c*2 and, in this upright posture, the operable member 62 is not pushed upward, i.e., the second valve device 28 is not opened.

In the supply chamber 25, there is provided the first valve device 27 that can shut off the communication between the inside, and the outside, of the ink cartridge 1; and in the air introducing chamber 26, there is provided the second valve device 28 that can also shut off the communication between the inside, and the outside, of the ink cartridge 1. In addition, an elastic plug 30 is press-fitted in the ink charging chamber 29. The elastic plug 30 can also shut off the communication between the inside, and the outside, of the ink cartridge 1. The first and second valve devices 27, 28 and the elastic plug 30 will be described below in more detail.

The bottom wall 21 of the main case 1*a* has, in a portion thereof located on the side of the supply chamber 25, a plurality of communication holes 31 through which the ink chamber 20 and the supply chamber 25 communicate with each other. In the vicinity of the communication holes 31, a through-hole 32 is formed in the bottom wall 21, and an axis portion 35 of a check valve 33 is loosely fitted in the through-hole 32 such that the check valve 33 is movable upward and downward in the same 32. The check valve 33 includes a large-diameter portion 36 as an intermediate portion of the axis portion 35 thereof, and an elastic membrane portion 34 provided in an axially end portion thereof.

The check valve 33 is supported by the bottom wall 21 such that under a normal condition, the elastic membrane portion 34 of the check valve 33 is kept, by the large-diameter portion 36, remote from the communication holes 31, so that the ink is allowed to flow from the ink chamber 20 to the supply chamber 25. However, when flows of the ink from the ink delivery tube 12 (FIG. 1) toward the ink chamber 20 may occur, the elastic membrane portion 34 of the check valve 33 is moved upward to close the communicate holes 31 and thereby inhibit those flows.

In addition, the bottom wall 21 of the main case 1*a* has, in a portion thereof located on the side of the air introducing chamber 26, a tubular, air introducing portion 40 that is integrally formed with the bottom wall 21 such that the air introducing portion 40 projects from the bottom wall 21 toward an upper portion of the ink chamber 20. An upper end of the air introducing portion 40 opens at a position higher than a level of the ink present in the ink chamber 20, and an inner flow passage 41 of the air introducing portion 40 communicates, at a lower end thereof, with the air introducing chamber 26.

A portion of the bottom wall 21 that defines the ink charging chamber 29 has a communication hole 45 through which the ink chamber 20 and the ink charging chamber 29 communicate with each other.

Here, the first valve device 27, provided in the supply chamber 25, is described in detail.

The first valve device 27 includes a support member 50 that is formed of an elastic material such as a rubber; and a valve member 51 that is formed of a resin. The support member 50 has a generally cylindrical shape, and includes a valve-seat portion 50*a* that is located in an intermediate portion thereof as seen in an axial direction thereof a biasing portion 50*b* that is located nearer to the ink chamber 20 than the valve-seat portion 50*a*; and an attachment portion 52 that is located around the valve-seat portion 50*a* and the biasing portion 50*b*. The valve-seat portion 50*a*, the biasing portion 50*b*, and the attachment portion 52 are formed integrally with each other. The valve member 51 is accommodated by an inner space of the biasing portion 50*b*, such that the valve member 51 is biased by the biasing portion 50*b* in a direction to seat on the valve-seat portion 50*a*.

The attachment portion 52 is sandwiched, and fixedly held, by a stepped surface 1*e* formed in an inner circumferential surface of the supply chamber 25, and the cap member 1*c*.

The valve-seat portion 50*a* has, in a central portion thereof an opening 54 that opens toward the valve member 51; an insertion hole 55 located under the opening 54; and a tapered introduction hole 56 located under the insertion hole 55. The opening 54, the insertion hole 55, and the introduction hole 56 cooperate with each other to define a through-hole that is formed through the valve-seat portion 50*a* in the axial direction of the support member 50. The insertion hole 55 has a size (e.g., an inner diameter) assuring that when the ink cartridge 1 is held by the cartridge holder 3, the ink delivery tube 12 of the holder 3 can be liquid-tightly inserted in the insertion hole 55.

The biasing portion 50*b* has a cylindrical side wall 57 that projects from the outer periphery of the valve-seat portion 50*a* in an upward direction toward the ink chamber 20; an annular portion 58 that projects in an inward direction from an upper end of the side wall 57 so as to contact a portion of the valve member 51 that is located on the side of the ink chamber 20; and an opening 58*a* formed in a central portion of the annular portion 58.

Figure 2:
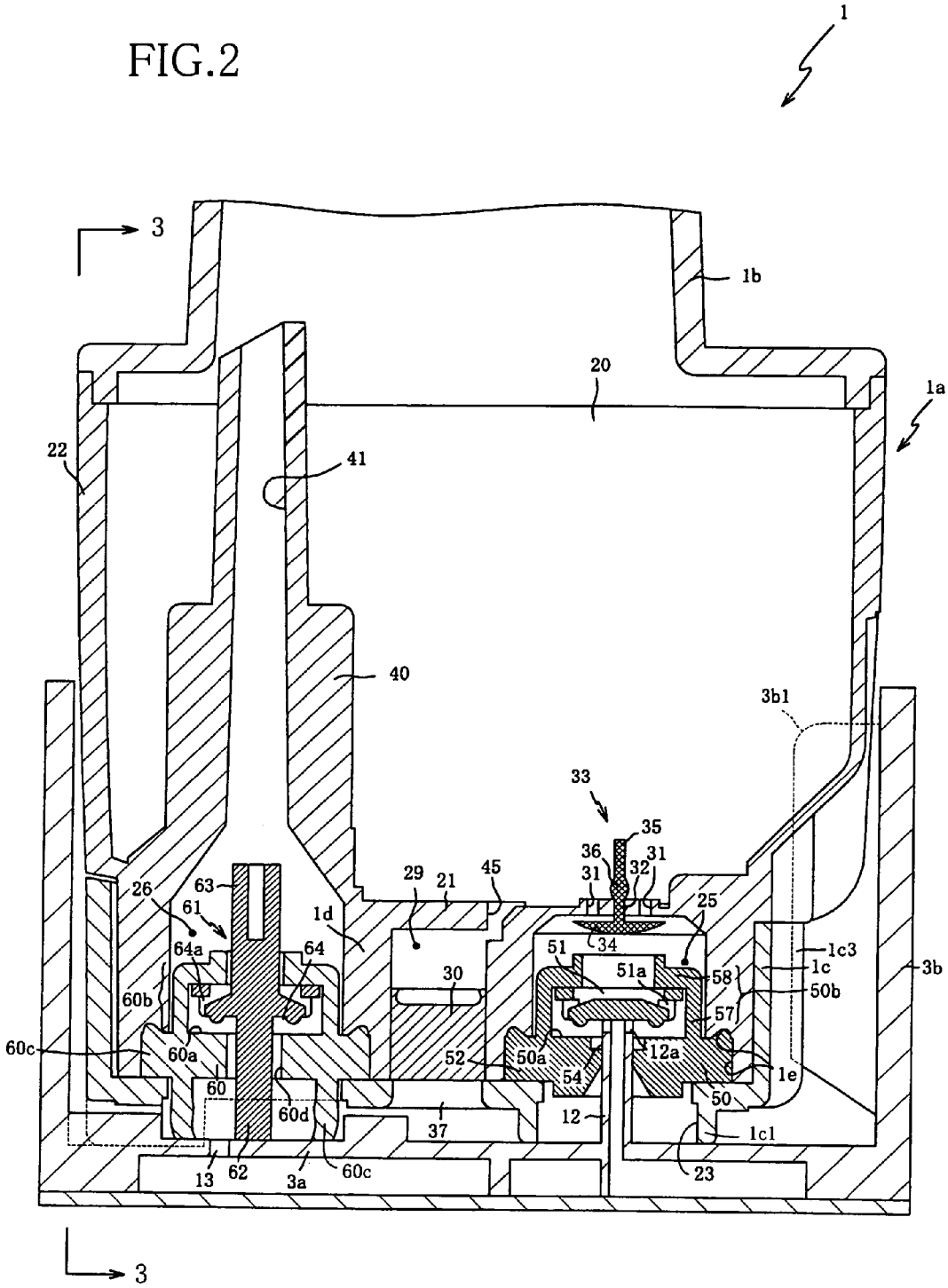
FIG. 2 is a cross-section view of the ink cartridge and a cartridge holder of the inkjet recording device that holds the ink cartridge.

The biasing portion 50*b* biases, owing to an elastic force of the side wall 57 and the annular portion 58, the valve member 51 in a direction to cause the valve member 51 to seat on the valve-seat portion 50*a*, so that under a normal condition, the valve member 51 is liquid-tightly seated on the valve-seat portion 50*a*. Meanwhile, when the ink cartridge 1 is held by the cartridge holder 3, as shown in FIG. 2, the ink delivery tube 12 is inserted in the insertion hole 55 so as to push the valve member 51 in an upward direction toward the ink chamber 20. Thus, the side wall 57 is stretched out and the annular portion 58 is moved in the upward direction, so that a gap functioning as an ink-flow passage is produced between a lower portion of the valve member 51 and the valve-seat portion 50*a*.

As shown in FIG. 2, the valve member 51 has a plurality of communication passages 51*a* through which the opening 58*a* of the biasing portion 50*b* communicates with a portion of the inner space of the biasing portion 50*b* that is located radially outward of a surface of the valve member 51 that can be liquid-tightly contacted with the valve-seat portion 50*a*. When the valve member 51 is pushed upward as described above, the ink chamber 20 is communicated with an upper end of the ink delivery tube 12 via the communication passages 51*a*, so that the ink is supplied to the ink delivery tube 12 via a plurality of notch-like communication ports 12*a* that are formed in the upper end of the tube 12.

Next, the second valve device 28, provided in the air introducing chamber 26, is described in detail.

Like the first valve device 27, the second valve device 27 includes a support member 60 that is formed of an elastic material such as a rubber; and a valve member 61 that is formed of a resin. Like the support member 50 of the first valve device 27, the support member 60 of the second valve device 28 includes a valve-seat portion 60*a*; a biasing portion 60*b*; and an attachment portion 60*c* that are formed integrally with each other. Since those portions 60*a*, 60*b*, 60*c* of the support member 60 have respective functions that are identical with those of the corresponding portions 50*a*, 50*b*, 52 of the support member 50, the description of those portions 60*a*, 60*b*, 60*c* is omitted.

The support member 60 has a through-hole 60*d* through which the operable portion 62 of the valve member 61 extends; and a cylindrical sealing portion 60*e* integrally projecting downward from a lower surface of the valve-seat portion 60*a*, such that the sealing portion 60*e* surrounds the through-hole 60*d*.

The valve member 61 includes an upper, cylindrical portion 63; the lower, operable portion 62; and an intermediate, valve portion 64.

The cylindrical portion 63 has a cylindrical shape projecting vertically upward from the valve portion 64, and extends through a central opening of the biasing portion 60*b* such that the cylindrical portion 63 is spaced from an inner circumferential surface of the biasing portion 60*b*. In addition, when the ink cartridge 1 is normally held by the cartridge holder 3 and accordingly the valve member 61 is moved upward, the cylindrical portion 63 is kept spaced from an inner circumferential surface of the inner flow passage 41 of the air introducing portion 40.

The operable portion 62 projects vertically downward from the valve portion 64 (FIG. 4), and extends through the through-hole 60*d* of the valve-seat portion 60*a* such that the operable portion 63 is kept spaced from an inner circumferential surface of the through-hole 60*d*.

The valve portion 64 is provided between the cylindrical portion 63 and the operable portion 62, and has a disc-like shape. Under a normal condition, a lower surface of the valve portion 64 is contacted with the valve-seat portion 60*a* so as to prevent flows of the ambient air through the second valve device 28. As shown in FIG. 2, when the ink cartridge 1 is held by the cartridge holder 3, the lower surface of the operable portion 62 is pushed upward by the base portion 3*a*, so that the valve member 61 is moved upward and a gap functioning as an air-flow passage is produced between the valve portion 64 and the valve-seat portion 60*a*. More specifically described, the sealing portion 60*e* air-tightly contacts an upper surface of the base portion 3*a* such that the sealing portion 60*e* surrounds the air supply hole 13 of the base portion 3*a*. Thus, the ink chamber 20 and the air supply hole 13 air-tightly communicate with each other. Like the valve member 51, the valve portion 64 has a plurality of communication passages 64*a* that allow, when the valve member 61 is pushed up, the ink chamber 20 to communicate with the through-hole 60*d*.

Next, the elastic plug 30 will be described in detail.

The elastic plug 30, press-fitted in the ink charging chamber 29, is formed of an elastic material such as a rubber, has a cylindrical shape, and is used in charging an ink into the ink chamber 20. The ink is charged into the ink chamber 20, in such a manner that first a protector 70, described later, is attached to the ink cartridge 1 that has already been assembled, and then air is discharged from the ink chamber 20 so as to decrease a pressure of the air in the same 20. The air pressure in the ink chamber 20 may be decreased by connecting a vacuum pump, not shown, to the insertion hole 55 or the through-hole 60*d*, pushing the valve member 51 or the valve member 61 upward, and operating the vacuum pump to discharge the air from the ink chamber 20. Alternatively, as shown in FIG. 4, the sealing plug 30 may be penetrated by a tubular needle 80 so that a vacuum pump can discharge air from the ink chamber 20 via the ink charging chamber 29 and the needle 80. Subsequently, another tubular needle, not shown, for charging ink is operated to penetrate the sealing plug 30 in the same manner as described above, so that an ink supply source, not shown, can charge ink into the ink chamber 20 via the needle and the ink charging chamber 29.

Though a through-hole is temporarily formed by the needle 80 penetrating the sealing plug 30, the through-hole is naturally closed by an elastic restoring deformation of the sealing plug 30, when the needle 80 is pulled out of the same 30. In addition, after the ink is charged into the ink chamber 20, the elastic plug 30 is pressed into the ink charging chamber 29, to a position where an upper surface of the plug 30 contacts a lower surface of the bottom wall 21. Thus, the communication passage 45 between the ink chamber 20 and the ink charging chamber 29 is shut off by the sealing plug 30, and an amount of ink remaining in the ink charging chamber 29 is pushed out into the ink chamber 20.

Next, the protector 70 will be described in detail.

Figure 5A:
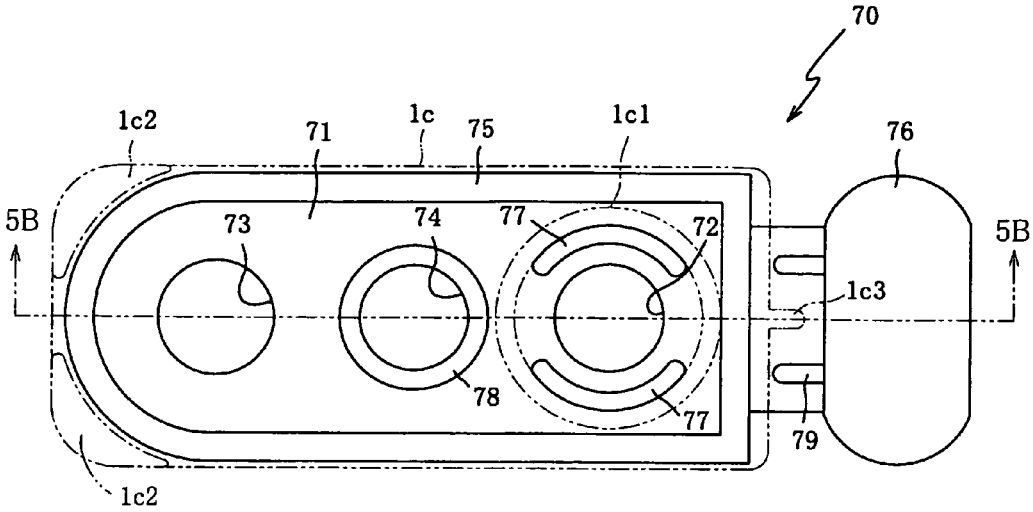
FIG. 5A is a plan view of the protector.
Figure 5B:
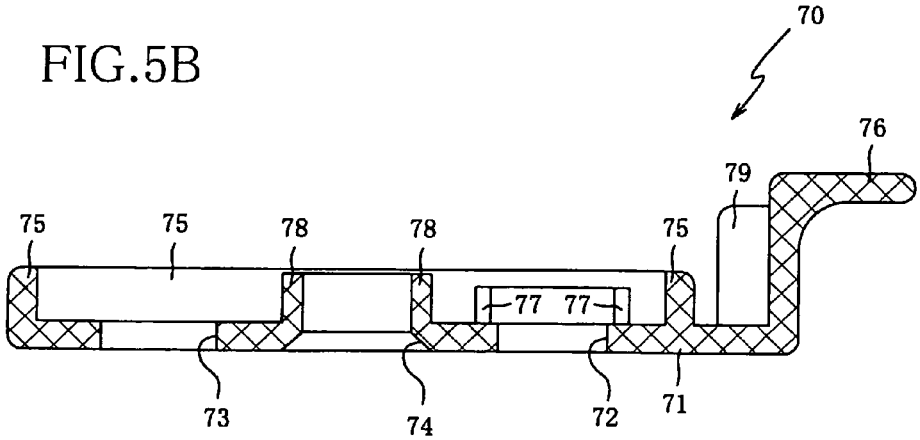
FIG. 5B is a cross-section view of the protector, taken along 5B-5B in FIG. 5A.

As shown in FIGS. 5A and 5B, the protector 70 has a main portion including a bottom wall 71 having a plan-view shape similar to that of the lower surface of the cap member 1*c* of the cartridge 1, i.e., the lower end surface of the cartridge 1, and additionally including a side wall 75 that projects upward from an outer periphery of the bottom wall 71. The protector 70 additionally has a lug 76 as an operable portion that is integral with one end portion of the main portion 71, 75. The bottom wall 71, the side wall 75, and the lug 76 are formed of a resin such that those elements 71, 75, 76 are integral with each other. The main portion 71, 75 has a rigidity assuring that the main portion 71, 75 can maintain its original shape.

Since the protector 70 has a color different from a color of each of the valve members 51, 61, a person such as a worker or a user can easily distinguish the protector 70 from the each valve member 51, 61. Thus, when the working person views the valve members 51, 61 with the naked eyes, the person can easily identify each one of the protector 70 and the valve members 51, 61, which leads to improving an operation efficiency as will be described later.

As shown in FIG. 5A, the bottom wall 71 has a flat shape whose one end (i.e., a left-hand end as seen in the figure) is substantially arcuate, and has a first view hole 72, a second view hole 73, and a third hole 74 that are formed through a thickness of the bottom wall 71, at respective positions corresponding to the ink supply hole 23, the air introducing hole 24, and the ink charging hole 37 of the ink cartridge 1, respectively. The protector 70 additionally includes a pair of fitting walls 77 each of which has an arcuate shape in its plan view and which cooperate with each other to surround the first view hole 72; and a cylindrical wall 78 that surrounds the third hole 74. The two fitting walls 77 and the cylindrical wall 78 integrally project upward from the bottom wall 71. Since the pair of fitting walls 77 are integral with the bottom wall 71 formed of resin, those fitting walls 77 are elastically deformable to some degree.

An outer diameter of the pair of arcuate fitting walls 77 is somewhat larger than an inner diameter of the cylindrical first projecting portion 1*c*1 of the cap member 1*c*. Since the fitting walls 77 are strongly press-fitted in the first projecting portion 1*c*1, owing to an elastic deformation of the resin as the material of the fitting walls 77, the protector 70 is strongly engaged with, and held by, the ink cartridge 1, owing to a frictional force produced between respective outer surfaces of the arcuate fitting walls 77 and an inner circumferential surface of the first projecting portion 1*c*1. This state is shown in FIG. 4. In this state, the lug 76 projects laterally from a portion of the side wall 75 that is located on the side of the ink supply hole 23 of the ink cartridge 1. In this state, if a person pushes the lug 76 in a downward direction, the fitting walls 77 are elastically deformed and are disengaged from the first projecting portion 1*c*1, so that the protector 70 can be detached from the ink cartridge 1.

However, in a modified embodiment of the present invention, an inner diameter of the pair of arcuate fitting walls 77 of the protector 70 may be somewhat smaller than an outer diameter of the cylindrical first projecting portion 1*c*1 of the cap member 1*c*. In this case, the fitting walls 77 can be strongly press-fitted on the first projecting portion 1*c*1, such that the protector 70 is strongly engaged with, and held by, the ink cartridge 1, owing to a frictional force produced between respective inner surfaces of the fitting walls 77 and an outer circumferential surface of the first projecting portion 1*c*1.

Figure 6:
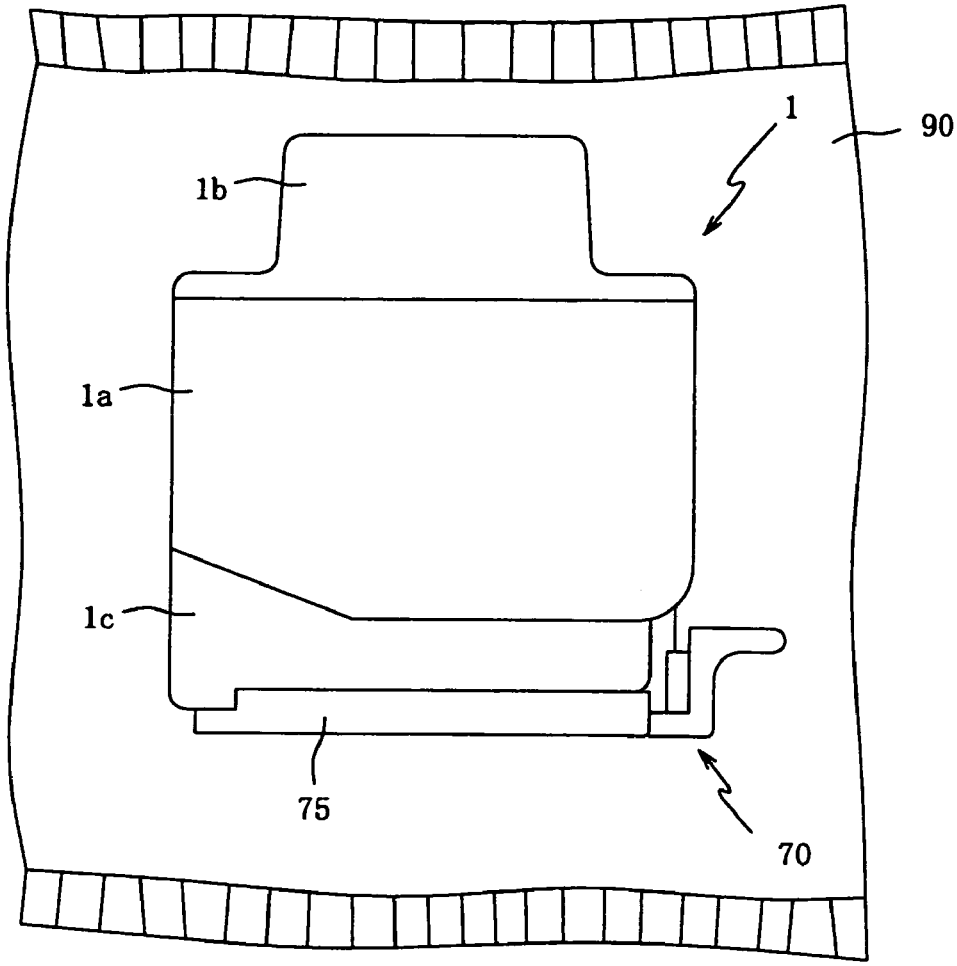
FIG. 6 is a view of the ink cartridge in a packaged state.

After the main case 1*a*, the lid member 1*b*, the cap member 1*c*, the two valve devices 27, 28, the elastic plug 30, and the check valve 33 are assembled into the ink cartridge 1, and before the ink is charged into the ink chamber 20, the protector 70 is applied or attached to the ink cartridge 1 in the above-described manner. Thereafter, the protector 70 remains attached to the ink cartridge 1, e.g., in a state in which the ink cartridge 1 is packaged as shown in FIG. 6, before the ink cartridge 1 is attached by a user to the cartridge holder 3 of the inkjet recording device 2.

In the state in which the protector 70 is attached to the ink cartridge 1, the bottom wall 71 extends parallel to the lower surface of the cap member 1*c* over the ink supply hole 23 and the air introducing hole 24, and the arcuate end portion of the bottom wall 71 is located inward of the two second projecting portions 1*c*2 of the cap member 1*c*. The protector 70 additionally includes two ribs 79 that project, while extending parallel to each other along the lug 76, upward from an opposite end portion of the bottom wall 71 that is opposite to the arcuate end portion thereof. The second rib 1*c*3 of the cap member 1*c* can be inserted in a space present between the two ribs 79 of the protector 70.

The third hole 74 of the protector 70 can be used as a route through which the needle 80 is inserted to penetrate the elastic lug 30 and inject the ink into the ink chamber 20.

A height dimension of the main portion 71, 75 of the protector 70, i.e., the bottom wall 71 and the side wall 75, as measured in a direction in which the operable portion 62 of the second valve device 28 projects downward from the lower surface of the cap member 1*c*, is substantially equal to, or greater than, an amount of downward projection of the operable portion 62 from the lower surface of the cap member 1*c* in the state in which the valve portion 64 of the valve member 61 is seated on the valve-seat portion 60*a*, and is substantially equal to, or greater than, an amount of downward projection of the two second projecting portions 1*c*2 from the lower surface of the cap member 1*c*. Therefore, in the state in which the protector 70 is attached to the ink cartridge 1 as above described and an upper end of the side wall 75 is held in contact with the lower surface of the cap member 1*c*, the operable portion 62 does not project downward beyond a lower surface of the protector 70, as shown in FIG. 4. Thus, the protector 70 can fully cover the operable portion 62.

In addition, the valve member 51 of the first valve device 27 is provided at a position sufficiently remote from the lower surface of the protector 70. Therefore, when the protector 70 is attached to the ink cartridge 1 and/or when the ink cartridge 1 with the protector 70 is shipped, a possibility that the valve member 51 or the operable portion 62 may be interfered with by a foreign matter or a working person and the ink may leak through the valve devices 27, 28 can be minimized.

A height dimension of the side wall 75 as measured from the bottom wall 71 is substantially equal to, or greater than, an amount of downward projection of the sealing portion 60*e* of the second valve device 28 from the lower surface of the cap member 1*c*. Therefore, in the state in which the protector 70 is attached to the ink cartridge 1, the sealing portion 60*e* can be effectively prevented from being permanently deformed by the bottom wall 71.

The first or second view hole 72, 73 of the protector 70 is not essentially needed for the purpose of restraining a foreign matter from interfering with the valve member 51 or the valve portion 64 of the ink cartridge 1. Thus, the protector 70 may be formed of a transparent material such as a transparent resin. However, in the present embodiment, the first and second view holes 72, 73 are provided for the purpose of inspecting whether each of the valve member 51 and the valve portion 64 has erroneously been assembled in a tilted state, whether each of the valve member 51 and the valve portion 64 has been tilted because of interference of a foreign matter or a working person before the protector 70 is attached to the ink cartridge 1, and/or whether ink is leaking from the first or second valve device 27, 28 because of other reasons.

Thus, a transverse cross-section area of each of the first and second view holes 72, 73 is determined at a value assuring that a person can view, through the each view hole 72, 73 from an outer side of the protector 70 that is opposite to the ink cartridge 1, a contour of a corresponding one of the insertion hole 55 and the through-hole 60*d* and at least a portion of a corresponding one of the valve member 51 and the valve portion 64 each of which is provided on an inner side of a corresponding one of the insertion hole 55 and the through-hole 60*d*. Preferably, the transverse cross-section area of each of the first and second view holes 72, 73 is determined to be larger than a transverse cross-section area of a corresponding one of the insertion hole 55 and the through-hole 60*d*.

In the state in which the protector 70 is attached to the ink cartridge 1, a center of the first view hole 72 is located substantially on a straight extension line extended from a straight passing line passing through a center of the ink supply hole 23 and the valve member 51; and a center of the second view hole 73 is located substantially on a straight extension line extended from a straight passing line passing through a center of the air introducing hole 24 and the valve portion 64. Thus, the transverse cross-section area of each of the first and second view holes 72, 73 can be minimized while assuring that a person can inspect, therethrough, a posture of a corresponding one of the valve member 51 and the valve portion 64 and a leakage of the ink from a corresponding one of the first and second valve devices 27, 28. Thus, the transverse cross-section area of each of the first and second view holes 72, 73 is smaller than a transverse cross-section area of a corresponding one of the ink supply hole 23 and the air introducing hole 24. However, the transverse cross-section area of the second view hole 73 is larger than a transverse cross-section area of the operable portion 62 of the valve member 61. Thus, each of the first and second view holes 72, 73 allows a person to inspect a posture of a corresponding one of the valve member 51 and the valve portion 64 and a leakage of the ink from a corresponding one of the first and second valve devices 27, 28, while restraining a foreign matter from interfering with each of the valve member 51 and the valve portion 64 or causing a leakage of the ink from each of the first and second valve devices 27, 28.

As shown in FIG. 6, when the ink cartridge 1 with the protector 70 is shipped, the ink cartridge 1 is packaged in an air-impermeable bag 90 formed of a resin. Then, air is sucked from the bag 90 to reduce an air pressure in the bag 90 and thereby provide a vacuum package of the ink cartridge 1. In this state, the bag 90 is closely contacted with the outer surface of the ink cartridge 1. Since, however, the ink cartridge 1 is protected by the protector 70, the operable portion 62 can be prevented from being pushed by the bag 90 and accordingly the ink can be prevented from leaking from the ink cartridge 1.

The bag 90 is formed of a transparent or translucent material assuring that a person can view, therethrough, the posture of each of the valve member 51 and the valve portion 64 and/or the leakage of ink from each of the valve devices 27, 28. Thus, even after the ink cartridge 1 is packaged in the bag 90, a working person can perform the valve inspecting operation.

While the present invention has been described in its preferred embodiment, the present invention may be embodied in different manners.

For example, in the above-described embodiment, each of the first and second view holes 72, 73 has a substantially circular transverse cross-section shape. However, each of the first and second view holes 72, 73 may have a different shape, such as a polygonal shape or an elliptic shape, so long as the each view hole 72, 73 assures that a person can inspect, therethrough, a corresponding one of the valve devices 27, 28.

In addition, in the above-described embodiment, the second valve device 28 employs the valve member 61 as shown in FIG. 4. However, the second valve device 28 may be replaced with a different valve device identical with the first valve device 27 employing the valve member 51. Likewise, the first valve device 27 may be replaced with a different valve device identical with the second valve device 28 employing the valve member 61.

In the above-described embodiment, the bottom wall 71 that cooperates with the side wall 75 to constitute an access-restraining portion has the first view hole 72 that is formed through the thickness thereof and that has a position and a size that assure that a person can view, therethrough, at least a portion of the first valve member 51 via the ink supply hole 23. Therefore, in the state in which the protector 70 is attached to the ink cartridge 1, a person can view, through the first view hole 72 of the protector 70, the first valve member 51 via the ink supply hole 23. Thus, even if the first valve member 51 may be tilted because of, e.g., an assembling error, the person can easily recognize the tiling of the valve 51, i.e., can early detect a defective ink cartridge 1 that might cause a leakage of the ink, or can early detect the leakage of the ink from the cartridge 1.

In the above-described embodiment, the center of the first view hole 72 is positioned substantially on a straight extension line extended from a straight passing line passing through the center of the first valve member 51 and the center of the ink supply hole 23. Therefore, through the first view hole 72 the cross-section area of which is minimized, the person can view the first valve member 51 via the ink supply hole 23. Since the cross-section area of the first view hole 72 can be minimized, the access-restraining portion 71, 75 can shield the first valve member 51 to a maximum degree and thereby effectively protect the same 51.

In the above-described embodiment, the cross-section area of the first view hole 72 is smaller than that of the ink supply hole 23. Therefore, when the ink cartridge 1 is manufactured, the protector 70 can prevent a worker from erroneously contacting the first valve member 51; and when a user attaches the ink cartridge 1 to the recording device 2, the protector 70 can effectively prevent the user from erroneously contacting the first valve member 51. Thus, the protector 70 can reliably protect the first valve member 51 from the time when the ink cartridge 1 is manufactured to the time when the cartridge 1 is attached to the recording device 2.

In the above-described embodiment, the ink cartridge 1 additionally includes the air introducing hole 24 which introduces the ambient air from the outside of the ink cartridge 1 into the ink chamber 20, and the second valve member 61 which is provided between the ink chamber 20 and the air introducing hole 24, and the bottom wall 71 covers the outer surface of the ink cartridge 1 over the ink supply hole 23 and the air introducing hole 24 and thereby prevent external accesses to each of the first and second valve members 51, 61 via a corresponding one of the ink supply hole 23 and the air introducing hole 24. Therefore, the protector 70 can prevent foreign matters (e.g., a person) from interfering with each of the first and second valve members 51, 61. Thus, the first and second valve members 51, 61 can be protected, and the leakage of the ink, caused by, e.g., tilting of the first or second valve member 51, 61 resulting from the interference, can be prevented.

In the above-described embodiment, the ink supply hole 23 and the air introducing hole 24 open in one end surface of the ink cartridge 1, and the bottom wall 71 covers the end surface of the ink cartridge 1 over the ink supply hole 23 and the air introducing hole 24. Therefore, in the state in which the protector 70 is attached to the ink cartridge 1, the first and second valve members 51, 61 can be protected, and can be viewed or inspected through the ink supply hole 23 and the air introducing hole 24, respectively. Thus, the bottom wall 71 can have a simplified shape, such as a substantially linear shape, which leads to reducing the production cost of the protector 70.

In the above-described embodiment, the bottom wall 71 has the second view hole 73 which is formed through the thickness thereof and which has a position and a size which assure that a person can view, therethrough, at least a portion of the second valve member 61 via the air introducing hole 24. Therefore, in the state in which the protector 70 is attached to the ink cartridge 1, a person can view, through the second view hole 73 of the protector 70, the second valve member 61 via the air introducing hole 24. Thus, the person can easily recognize, e.g., the tiling of the second valve member 61, and can stop shipping the defective ink cartridge 1.

In the above-described embodiment, the center of the second view hole 73 is positioned substantially on a straight extension line extended from a straight passing line passing through the center of the second valve member 61 and the center of the air introducing hole 24. Therefore, through the second view hole 73 the cross-section area of which is minimized, the person can view the second valve member 61 via the air introducing hole 24. Since the cross-section area of the second view hole 73 can be minimized, the bottom wall 71 can shield the second valve member 61 to a maximum degree and thereby effectively protect the same 61.

In the above-described embodiment, the cross-section area of the second view hole 73 is smaller than that of the air introducing hole 24. Therefore, when the ink cartridge 1 is produced, the protector 70 can prevent a worker from erroneously contacting the second valve member 61; and when a user attaches the ink cartridge 1 to the recording device 2, the protector 70 can prevent the user from erroneously contacting the second valve member 61. Thus, the protector 70 can reliably protect the second valve member 61 from the time when the ink cartridge 1 is produced to the time when the cartridge 1 is attached to the recording device 2.

In the above-described embodiment, the second valve member 61 includes the operable portion 62 which extends through the air introducing hole 24 and projects from the outer surface of the ink cartridge 1 into the outside of the ink cartridge 1 so that the operable portion 62 is externally operable to operate the second valve member 61, and the dimension of the access-restraining portion, i.e., the bottom wall 71 and the side wall 75, that is measured in the direction in which the operable portion 62 projects from the outer surface of the ink cartridge 1 into the outside, is substantially equal to, or greater than, the amount of projection of the operable portion 62 from the outer surface of the ink cartridge 1 into the outside. Therefore, in the state in which the protector 70 is attached to the ink cartridge 1, the access-restraining portion 71, 75 can cover the outer surface of the ink cartridge 1 such that the operable portion 62 of the second valve member 61 does not project beyond the access-restraining portion 71, 75. Therefore, when the ink cartridge 1 is produced or shipped, the protector 70 can prevent foreign matters from erroneously contacting the operable portion 62 and thereby reliably protect the second valve member 61.

In the above-described embodiment, the ink cartridge 1 additionally includes the first and second projecting portions **1*c*1, 1*c*2 as the at least one protruding portion that project or protrude from the outer surface thereof in an outward direction parallel to the direction of projection of the operable portion 62 of the second valve member 61, and the dimension of the access-restraining portion 71, 75 is substantially equal to, or greater than, the amount of protrusion of the at least one protruding portion 1*c*2 from the outer surface of the ink cartridge 1. Therefore, in the state in which the protector 71 is attached to the ink cartridge 1, the access-restraining portion 71, 75 covers the outer surface of the ink cartridge such that the at least one protruding portion 1*c*1, 1*c*2 does not protrude beyond the access-restraining portion 71, 75. In addition, since the amount of protrusion of the at least one protruding portion 1*c*1, 1*c*2 from the outer surface of the ink cartridge 1 is substantially equal to, or greater than, the amount of projection of the operable portion 62 of the second valve member 61 from the outer surface of the ink cartridge 1. Therefore, even in a state in which the protector 71 is not attached to the ink cartridge 1, the at least one protruding portion 1*c*1, 1*c*2 can restrain foreign matters from interfering with the operable portion 62 of the second valve member 61 and thereby protect the second valve member 61**.

In the above-described embodiment, the access-restraining portion 71, 75 has a color different from a color of at least one of the first and second valve members 51, 61. Therefore, a person can easily distinguish the access-restraining portion 71, 75 from the first and/or second valve members 51, 61. Thus, a worker can easily identify the first and/or second valve members 51, 61, which leads to improving the operation efficiency of the worker.

It is to be understood that the present invention may be embodied with other changes and improvements that may occur to a person skilled in the art, without departing from the spirit and scope of the invention defined in the appended claims.

What is claimed is:

1. A combination of a protector and an ink cartridge, the ink cartridge comprising:

an ink chamber which stores ink;

an ink supply hole formed through the ink cartridge and through which ink flows from an interior of the ink chamber to an exterior of the ink cartridge and which opens in an opening portion of an outer surface of the ink cartridge; and a first valve member which is provided between the ink chamber and the ink supply hole, which selectively permits ink to flow from the ink chamber to the ink supply hole and inhibits ink from flowing from the ink chamber to the ink supply hole, and which communicates with the exterior of the ink cartridge via the ink supply hole, the protector comprising:

a main portion comprising an engaging portion which is adapted to engage a portion of the ink cartridge, so that the protector is detachably attached to the ink cartridge, wherein the main portion is substantially rigid thereby assuring that the main portion substantially maintains an original shape thereof, wherein the main portion further comprises an access-restraining portion which is located outside the ink supply hole, when the protector is attached to the ink cartridge, so as to at least partially cover the opening portion of the outer surface of the ink cartridge and thereby limit external access to the first valve member via the ink supply hole, wherein the ink cartridge further comprises:

an air introducing hole which introduces air from the exterior into the interior of the ink chamber; and a second valve member which is disposed between the ink chamber and the air introducing hole, which selectively permits air to flow from the exterior into the interior of the ink chamber and inhibits air from flowing from the exterior into the interior of the ink chamber, and which communicates with the exterior of the ink cartridge via the air introducing hole, and wherein the access-restraining portion covers the outer surface of the ink cartridge over the ink supply hole and the air introducing hole and thereby restrains the external access to each of the first and second valve members via a corresponding one of the ink supply hole and the air introducing hole.

2. The combination according to claim 1, wherein the engaging portion of the main portion is detachable from the ink cartridge when the ink cartridge is used with an ink jet recording device.

3. The combination according to claim 1, wherein the main portion is formed of a resin.

4. The combination according to claim 1, wherein the engaging portion is formed of an elastically deformable material, such that the engaging portion is elastically deformable during attachment and detachment of the protector to and from the ink cartridge, respectively.

5. The combination according to claim 1, wherein the protector further comprises an operable portion which is integral with the main portion and which is operable to detach the protector from the ink cartridge.

6. The combination according to claim 1, wherein the access-restraining portion has a first view hole which is formed through a thickness thereof and which has a position and a size, such that at least a portion of the first valve member is visible via the ink supply hole.

7. The combination according to claim 6, wherein a center of the first view hole is positioned substantially on an axis passing through a center of the first valve member and a center of the ink supply hole.

8. The combination according to claim 6, wherein a transverse cross-sectional area of the first view hole is less than a transverse cross-sectional area of the ink supply hole.

9. The combination according to claim 1, wherein the ink supply hole and the air introducing hole open in an end surface of the ink cartridge at the outer surface thereof, and wherein the access-restraining portion covers the end surface of the ink cartridge over the ink supply hole and the air introducing hole.

10. The combination according to claim 1, wherein the access-restraining portion comprises a second view hole which is formed through a thickness thereof and which has a position and a size, such that at least a portion of the second valve member is visible via the air introducing hole.

11. The combination according to claim 10, wherein a center of the second view hole is positioned substantially on an axis passing through a center of the second valve member and a center of the air introducing hole.

12. The combination according to claim 10, wherein a transverse cross-sectional area of the second view hole is less than a transverse cross-sectional area of the air introducing hole.

13. The combination according to claim 1, wherein the second valve member comprises an operable portion which extends through the air introducing hole and projects from the outer surface of the ink cartridge into the exterior of the ink cartridge, so that the operable portion is externally operable to operate the second valve member, and wherein a dimension of the access-restraining portion that is measured in a direction in which the operable portion projects from the outer surface of the ink cartridge into the exterior of the ink cartridge, is greater than an amount of projection of the operable portion from the outer surface of the ink cartridge into the exterior of the ink cartridge, so that when the protector is attached to the ink cartridge, the access-restraining portion covers the outer surface of the ink cartridge, such that the operable portion of the second valve member does not project beyond the access-restraining portion.

14. The combination according to claim 13, wherein the ink cartridge further comprises at least one protruding portion which protrudes from the outer surface thereof in an outward direction parallel to the direction of projection of the operable portion of the second valve member, and wherein said dimension of the access-restraining portion is greater than an amount of protrusion of said at least one protruding portion from the outer surface of the ink cartridge, so that when the protector is attached to the ink cartridge, the access-restraining portion covers the outer surface of the ink cartridge, such that said at least one protruding portion does not protrude beyond the access-restraining portion.

15. The combination according to claim 1, wherein the main portion has a color different from a color of the first valve member.

16. The combination according to claim 1, wherein the main portion has a color different from a color of the second valve member.

17. The combination according to claim 1, wherein the engaging portion comprises one of a first fitting portion and a second fitting portion in which the first fitting portion is press-fitted, and wherein the ink cartridge comprises the other of the first fitting portion and the second fitting portion.

18. The combination according to claim 17, wherein the access-restraining portion has a first view hole which is formed through a thickness thereof, and wherein said one of the first fitting portion and the second fitting portion at least partially surrounds the first view hole and the other of the first fitting portion and the second fitting portion at least partially surrounds the ink supply hole opening in the outer surface of the ink cartridge.

19. The combination according to claim 1, wherein the ink cartridge further comprises an ink charging hole through which ink is charged into the ink chamber, and wherein the access-restraining portion has a through-hole through which ink is charged into the ink chamber via the ink charging hole.

20. A combination of a protector and an ink cartridge, the ink cartridge comprising:

an ink chamber which stores ink;

an ink supply hole formed though the ink cartridge and though which ink flows from an interior of the ink chamber to an exterior of the ink cartridge and which opens in an opening portion of an outer surface of the ink cartridge; and a valve member which is provided between the ink chamber and the ink supply hole, which selectively permits ink to flow from the ink chamber to the ink supply hole and inhibits ink from flowing from the ink chamber to the ink supply hole, and which communicates with the exterior of the ink cartridge via the ink supply hole, the protector comprising:

a main portion comprising an engaging portion which is adapted to engage a portion of the ink cartridge, so that the protector is detachably attached to the ink cartridge, wherein the main portion is substantially rigid thereby assuring that the main portion substantially maintains an original shape thereof, wherein the main portion further comprises an access-restraining portion which is located outside the ink supply hole, when the protector is attached to the ink cartridge, so as to at least partially cover the opening portion of the outer surface of the ink cartridge and thereby limit external access to the valve member via the ink supply hole, wherein the engaging portion comprises one of a first fitting portion and a second fitting portion in which the first fitting portion is press-fitted, and the ink cartridge comprises the other of the first fitting portion and the second fitting portion, and wherein the access-restraining portion has a view hole which is formed through a thickness thereof, and said one of the first fitting portion and the second fitting portion at least partially surrounds the view hole and the other of the first fitting portion and the second fitting portion at least partially surrounds the ink supply hole opening in the outer surface of the ink cartridge.

* * * * *